United States Patent [19]

Grabow et al.

[11] 4,309,158

[45] Jan. 5, 1982

[54] GEAR POSITIVE DISPLACEMENT MACHINE WITH U-SHAPED SUPPORTING ELEMENT FOR SEALING MEMBER

[75] Inventors: Kurt Grabow, Feucht; Willy Mahl, Ditzingen; Karl-Heinz Müller, Vaihingen; Heinrich Kochendörfer, Kernen; Dieter Bertsch, Neuhausen; Siegfried Mayer; Jörg Anhenn, both of Vaihingen; Wilhelm Dworak, Stuttgart, all of Fed. Rep. of Germany

[73] Assignee: Robert Bosch GmbH, Stuttgart, Fed. Rep. of Germany

[21] Appl. No.: 84,793

[22] Filed: Oct. 15, 1979

[30] Foreign Application Priority Data

Nov. 3, 1978 [DE] Fed. Rep. of Germany ..... 2847711

[51] Int. Cl.[3] ..... F03C 2/08; F04C 2/18; F04C 15/00

[52] U.S. Cl. ..... 418/132

[58] Field of Search ..... 418/131, 132

[56] References Cited

U.S. PATENT DOCUMENTS

| | | | |
|---|---|---|---|
| 3,473,476 | 10/1969 | Davidson | 418/132 |
| 3,748,063 | 7/1973 | Putnam | 418/132 |
| 3,891,360 | 6/1975 | Dworak et al. | 418/132 |

*Primary Examiner*—John J. Vrablik

*Attorney, Agent, or Firm*—Michael J. Striker

[57] ABSTRACT

A gear positive displacement machine has two meshing gear members each having two axially opposite shafts, two pairs of bearing members each of which pairs bears one shaft of both gear members, at least one sealing member at one axial end of the gear members, and a supporting element reinforcing this sealing member. The supporting element has a U-shaped cross-section with two arms and a bead at a free end of each arm. The sealing member is inserted by its base side in the supporting member, and the beads of the arms of the latter engage in two grooves formed in the supporting member.

9 Claims, 8 Drawing Figures

GEAR POSITIVE DISPLACEMENT MACHINE WITH U-SHAPED SUPPORTING ELEMENT FOR SEALING MEMBER

BACKGROUND OF THE INVENTION

The present invention relates to a gear positive displacement machine, such as a hydraulic pump or a hydraulic motor. More particularly, it relates to such a gear positive displacement machine which has a sealing member of a flexible material, and a supporting member for reinforcing the sealing member.

Gear positive displacement machines of the abovementioned general type are known in the art. In the known machine, the supporting member loosely lies on the outer periphery and the inner periphery of the sealing member. Such a construction has the disadvantage in that the known long and thin supporting elements are difficult to mount and can be mounted improperly because they are very uneven when they come out of injection molds.

SUMMARY OF THE INVENTION

Accordingly, it is an object of the present invention to provide a gear positive displacement machine which avoids the disadvantages of the prior art.

More particularly, it is an object of the present invention to provide a gear positive displacement machine in which the mounting of a sealing member and a supporting element is very simple due to their interconnection, during insertion of them into a receiving recess.

In keeping with these objects and with others which will become apparent hereinafter, one feature of the present invention resides, briefly stated, in a gear positive displacement machine in which a supporting element has a U-shaped cross-section including two arms provided with two beads, and a sealing element has a base side inserted in the supporting element and two grooves in which the beads of the latter engage.

In such a construction, the sealing member and the supporting element are easily and reliably connected with one another.

In accordance with another feature of the present invention, the beads are formed at free ends of the arms, the beads are rounded and extend toward one another inwardly of the supporting element.

Two such sealing members and supporting elements may be provided at two axially opposite sides of the inventive gear positive displacement machine.

The thus-connected sealing member and supporting element may be accommodated in a recess provided either in bearing members which bear one shaft of both gear members of the machine, or in a cover member covering one axial end of an inner hollow of a housing of the machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
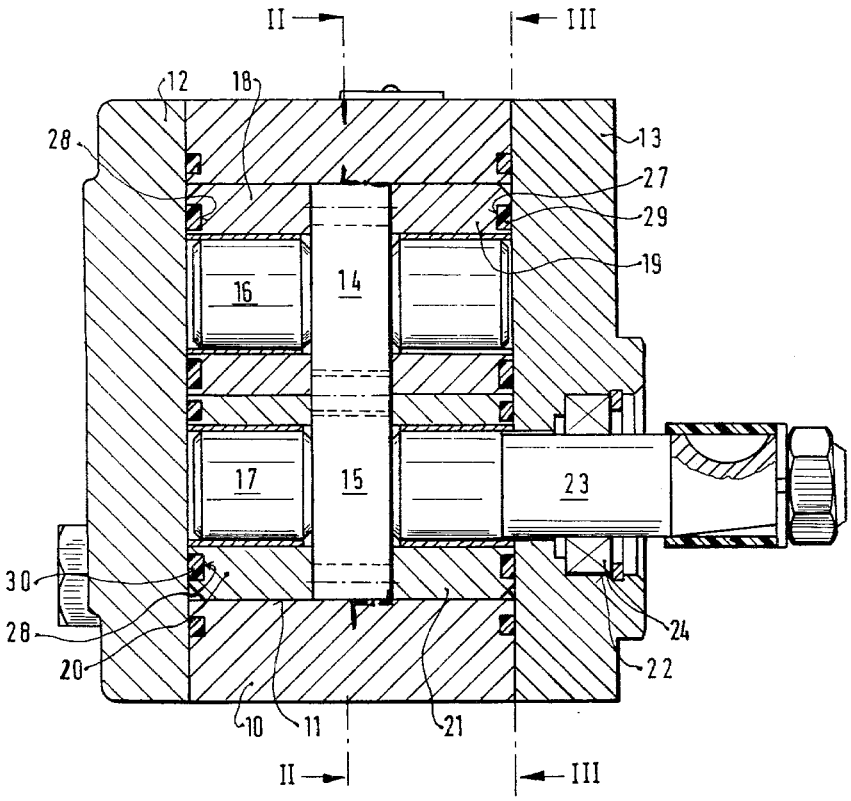
FIG. 1 is a view showing a longitudinal section of a gear pump in accordance with the present invention.
Figure 3:
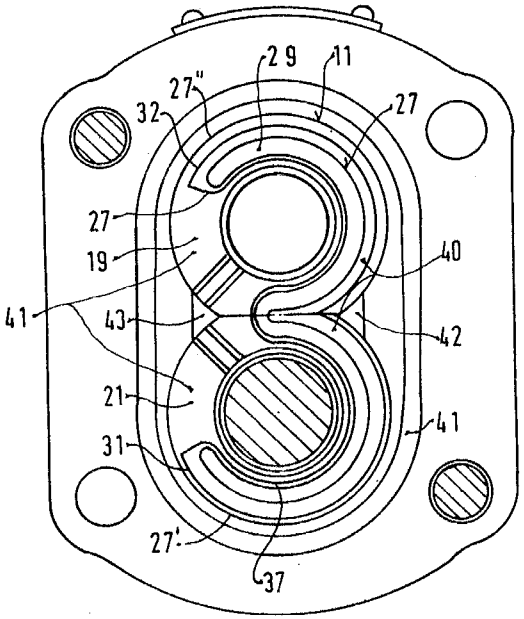
FIG. 3 is a view showing a section taken along line III—III of FIG. 1.
Figure 2:
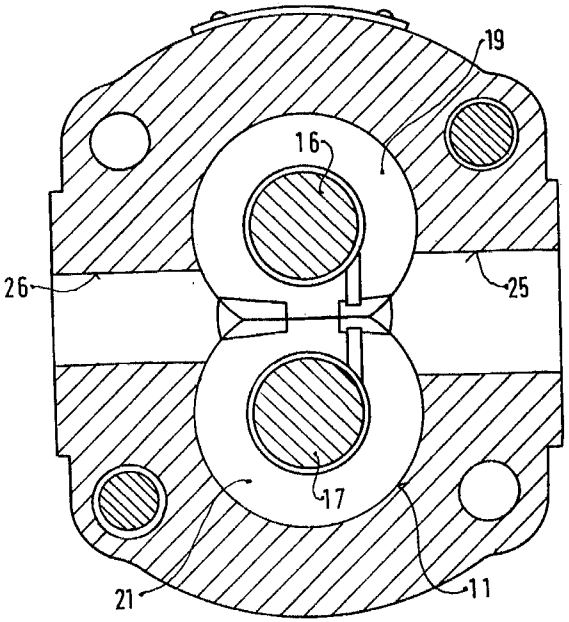
FIG. 2 is a view showing a section taken along line II—II of FIG. 1.
Figure 4:
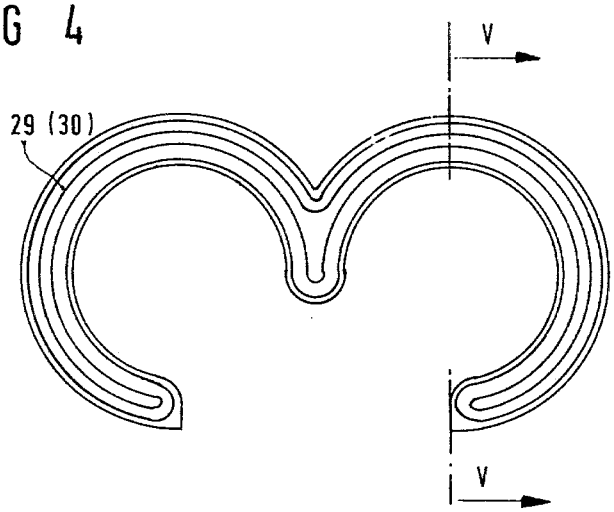
FIG. 4 is a view showing a sealing member of the inventive gear pump.
Figure 6:
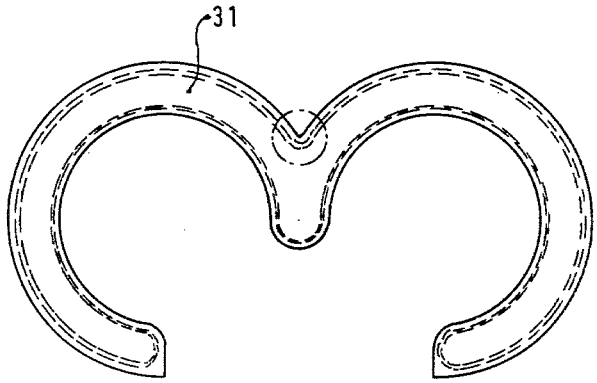
FIG. 6 is a plan view of the supporting element.
Figure 5:
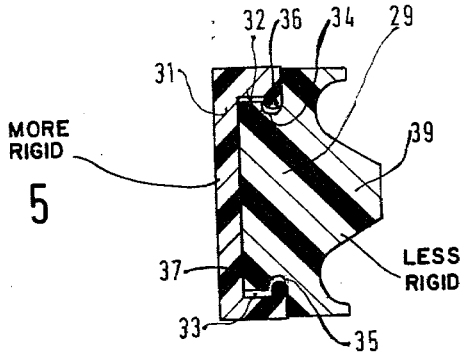
FIG. 5 is a view showing a section taken along line V—V of FIG. 4 illustrating the cross-section of the sealing member and a supporting element.

A gear positive displacement machine in accordance with the present invention such as a hydraulic pump or a hydraulic motor, has a housing 10 with a through-going housing recess 11 which is shaped as number eight. The through-going recess 11 is closed at its both lateral ends by covers 12 and 13. The covers 12 and 13 are connected with the housing 10 by not-shown screws.

Two gears 14 and 15 are accommodated in the housing recess 11 and mesh with each other in their peripheral regions. The gears 14 and 15 have shafts 16 and 17, respectively, which are supported in holes of bushes 18, 19, 20 and 21. The latter are advantageously constituted of aluminum. The bushes 18 and 19 are arranged for supporting the gear 14, whereas the bushes 20 and 21 are arranged for supporting the gear 15. The bushes 18–21 have end faces which are opposite to the respective gears 14 and 15 and flush with the end faces of the housing 10. A through-going opening 22 is further formed in the cover 13. A driving shaft 23 of the gear 15 extends through this opening 22 outwardly. A sealing ring 24 is provided in the opening 22 for sealing the driving shaft 23.

The bushes 18–21 have a shape corresponding to the shape of the recess 11 of the housing 10. In other words, they are cylindrical and have a flattening by which they abut against each other. An inlet opening 25 extends from the outer face of the housing 10 into the housing recess 11, at the height corresponding to the height of the gears 14 and 15. An outlet opening 26 extends in the same axial direction at the height of the gears 14 and 15, and leads from the housing recess 11 to the outer face of the housing 10.

The end faces of the bushes 18–21 which are opposite to the gears 14 and 15, are provided with recesses 27 and 28. Each of the recesses 27 and 28 extends continuously over two bushes located adjacent to one another. A seal 29 is arranged in the recess 27, and a seal 30 is arranged in the recess 28. Both seals 29 and 30 have a shape of number three. The arcuate portions of the seals surround the shafts at a small distance from the same.

The seals 29 and 30 are constituted of elastic rubber material. Since modern high-output machines operate with the pressure to 300 bar and more, there is a danger that the seals can be destroyed by the high pressure. In order to prevent such a destruction, the seals are provided with support elements. Only one of the inventive support elements is shown in FIGS. 4–7. This support element is utilized for supporting the seal 29 and identified by reference numeral 31.

Figure 7:
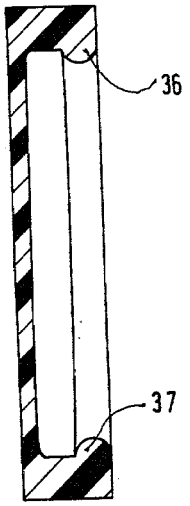
FIG. 7 is a view showing a cross-section of the supporting element.
Figure 8:
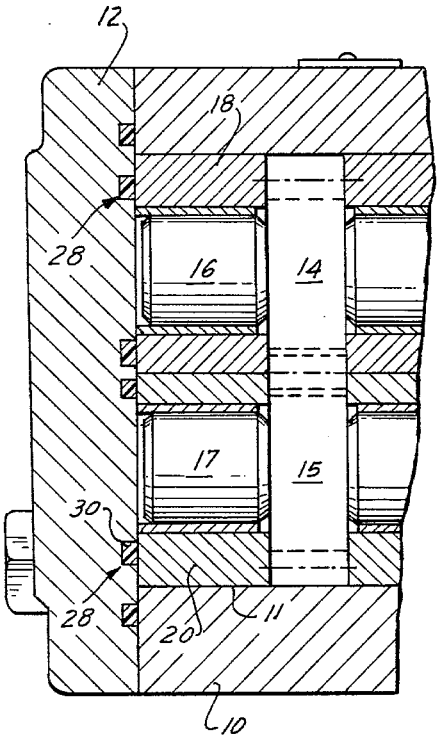
FIG. 8 is a view substantially corresponding to the view of FIG. 1 but showing another embodiment of the inventive gear pump.

A bottom of the seal 29, that is the portion facing toward a bottom of the recess, is provided at its inner and outer periphery with recesses 32 and 33 which have a rectangular cross-section and grooves 34 and 35 at their ends. The supporting element 31 has, in the plan view, a shape corresponding to the shape of the seal 29. However, the supporting element 31 has a U-shaped cross-section with two arms and inwardly extending beads 36 and 37 at the free ends of these arms. This is also shown in FIG. 7. Joining of the seal and the supporting ring is thereby very simple. The seal 29 is pressed with its bottom portion into the supporting element, so that the beads 36 and 37 engage into the grooves 34 and 35 with snap action. Since the supporting element is constituted of a material which is more rigid than the material of the seal 29, advantageously of polyamide, the thus-produced combination has a considerably high strength, without undesirably affecting the sealing action. The seal together with the supporting element is inserted into the recesses 27 and 28, whereafter the covers 12 and 13 are screwed to the housing 10. The recesses 27 and 28 may be alternately provided in the covers 12 and 13, as shown in FIG. 8.

The seal 29 may have any cross-section. In the above-mentioned case, the seal 29 has, however, a raised portion 39 in the central region thereof. By the seals 29 and 30, two pressure zones are separated from each other at each side of the bushes 18–21, the side being opposite to the gears. The pressure zones at the side whereat the seal 29 lies, are identified by reference numerals 40 and 41. The pressure zone 40 is loaded by high pressure through a triangular housing recess 42 and forms a high pressure zone, whereas the pressure zone 41 communicates with a low pressure side through a triangular housing recess 43 and thereby forms a low pressure zone of the machine.

It will be understood that each of the elements described above, or two or more together, may also find a useful application in other types of constructions differing from the types described above.

While the invention has been illustrated and described as embodied in a gear positive displacement machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A positive displacement gear machine, comprising a housing bounding an inner hollow; two rotatable gear members located in said hollow so as to cooperate with a working fluid and to subdivide said hollow into a low pressure zone and a high pressure zone, said gear members meshing with each other, each of said gear members having an axis, two axial end faces, and a shaft extending in opposite axial directions from said axial end faces; two pairs of bearing members located in said hollow of said housing, each pair of said bearing members being arranged to bear said shafts of both gear members at respective axial side of the latter, at least one pair of said bearing members abutting against one axial end face of both gear members under the action of pressure of the pressure zone; a sealing member bounding the pressure zone at one axial side of said gear members and having a shape substantially corresponding to the shape of number three, said sealing member having a cross-section including a base side and two recesses; and a supporting element having a shape corresponding to the shape of said sealing member and being constituted of a material which is more rigid than the material of the sealing member, said supporting element having a U-shaped cross-section which includes two arms each provided with a bead, each of said beads of said arms engaging in a respective one of said recesses of said sealing element, and said sealing element being inserted into said supporting element by said base side of the former, so that said supporting element reinforces said sealing element.

2. A machine as defined in claim 1, wherein said supporting element is constituted of polyamide.

3. A machine as defined in claim 1, wherein said supporting element has a connecting portion which connects said arms with one another, each of said arms having a free end section spaced from said connecting portion, said beads being arranged on said free end sections of said arms.

4. A machine as defined in claim 1, wherein said beads are rounded.

5. A machine as defined in claim 1, wherein said beads extend toward one another and inwardly of said supporting element.

6. A machine as defined in claim 1; and further comprising a second such sealing member bounding the pressure zone at the other axial side of said gear members, and provided with a second such supporting element.

7. A machine as defined in claim 1, wherein said inner hollow of said housing has an axis and two open axial ends; and further comprising two cover members closing said axial ends of said inner hollow and laterally abutting against said pairs of said bearing members, said one pair of said bearing members forming one part, whereas the cover member which laterally abuts against said one pair of said bearing members forms another part; and further comprising means forming an axial end groove in one of said parts, said sealing member together with said supporting element being located in said axial end groove.

8. A machine as defined in claim 7, wherein said axial end groove in which said sealing member with said supporting element are located, is formed in said one pair of said bearing members.

9. A machine as defined in claim 7, wherein said end groove in which said sealing member with said supporting element are located is formed in the cover member which laterally abuts against said one pair of said bearing members.

* * * * *